United States Patent [19]

Sandberg et al.

[11] 4,405,186

[45] Sep. 20, 1983

[54] MOVABLE GRID STACKER FOR A FOOD SLICING MACHINE

[75] Inventors: Glenn A. Sandberg, Lockport; Scott A. Lindee, New Lenox, both of Ill.

[73] Assignee: Formax, Inc., Mokena, Ill.

[21] Appl. No.: 308,252

[22] Filed: Oct. 5, 1981

[51] Int. Cl.[3] ..... B26C 7/30; B26C 7/32

[52] U.S. Cl. ..... 414/21; 83/77; 83/92; 271/218; 414/45; 414/50; 414/786

[58] Field of Search ..... 414/21, 45, 47, 48, 414/49, 50, 786; 83/77, 91, 92; 271/158, 159, 218; 198/865

[56] References Cited

U.S. PATENT DOCUMENTS

| | | | |
|---|---|---|---|
| 2,903,032 | 9/1959 | Cervene . | |
| 3,099,304 | 7/1963 | Monsees et al. . | |
| 3,161,215 | 12/1964 | Werder et al. | 83/92 X |
| 3,204,676 | 9/1965 | Gillman . | |
| 3,298,683 | 1/1967 | Stroud | 271/218 |
| 3,378,052 | 4/1968 | Dekker et al. . | |
| 3,498,600 | 3/1970 | Spencer et al. | 271/218 X |
| 3,508,591 | 4/1970 | Johnson et al. . | |
| 3,545,588 | 12/1970 | Corley | 198/865 X |
| 3,587,688 | 6/1971 | Toby . | |
| 3,824,885 | 7/1974 | Marshall et al. | 83/19 |
| 3,831,471 | 8/1974 | Rehlander | 83/91 |
| 3,842,698 | 10/1974 | Fitch et al. | 83/91 X |

FOREIGN PATENT DOCUMENTS 21465 of 1912 United Kingdom ..... 271/159

OTHER PUBLICATIONS

"Hopper Stack Elevating Control Mechanism", IBM Technical Disclosure Bulletin vol. 4, No. 2; Jul. 1961.

*Primary Examiner*—Leslie J. Paperner

*Attorney, Agent, or Firm*—Kinzer, Plyer, Dorn & McEachran

[57] ABSTRACT

This invention is a stacker for a food loaf slicing machine of the kind in which a food loaf is advanced into a slicing station where slices of generally uniform thickness are cyclically sliced from the end of the loaf. The stacker includes first and second stack supports which are positionable to receive slices as they are cut off the loaf. When one stack support has received a complete stack that support is moved to a displaced discharge position and the other stack support immediately moves into an initial slice receiving position immediately adjacent the slicing station, where it can receive a first food loaf slice as cut with essentially no free fall. The stack support is then displaced downwardly approximately one additional slice thickness for each successive slice received, so that each food loaf slice is added to the stack with no free fall. The stack supports transfer the stack to the discharge position without any free fall; continuous support is provided throughout all stack formation and transfer operations.

8 Claims, 12 Drawing Figures

24
26
22
20
18
12
26
14
28
16
30
41
42B
42A
44
62
34
44
40A
40B
50
52
64
44
46
10
38B
32
54
36B
37
36A
44
38A
48
58
91
60
66
56

82
80
76
84
3
80
26
28
24
14
26
12
30
34
10
56
64
32
91
66
48
80
86
74
112
68
72
92
87
68
96
100
68
3
70
70

Fig. 5.
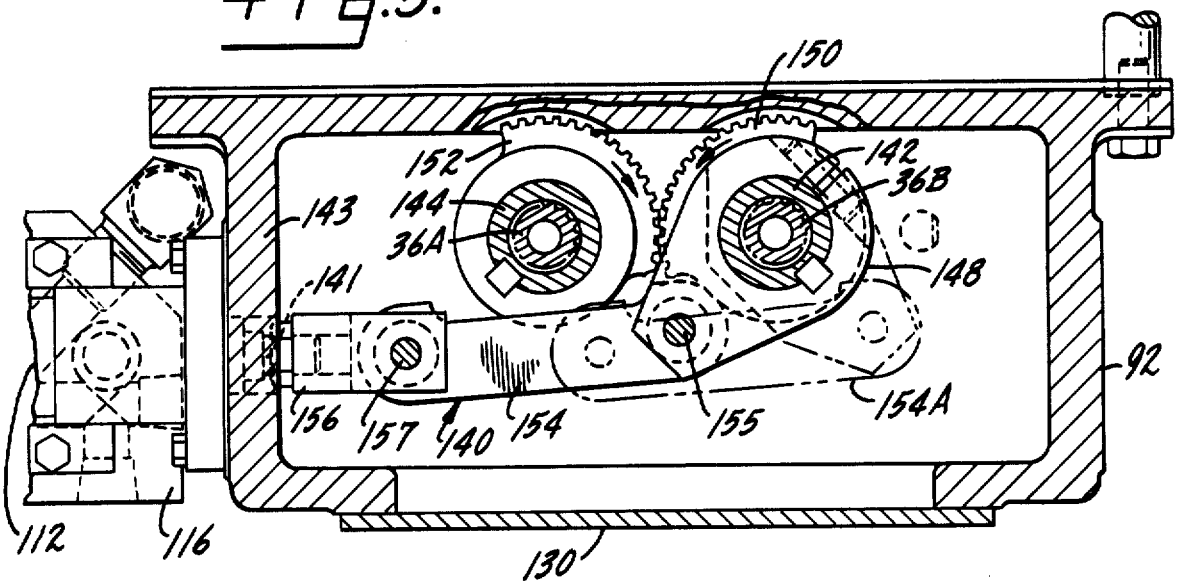
Fig. 6.
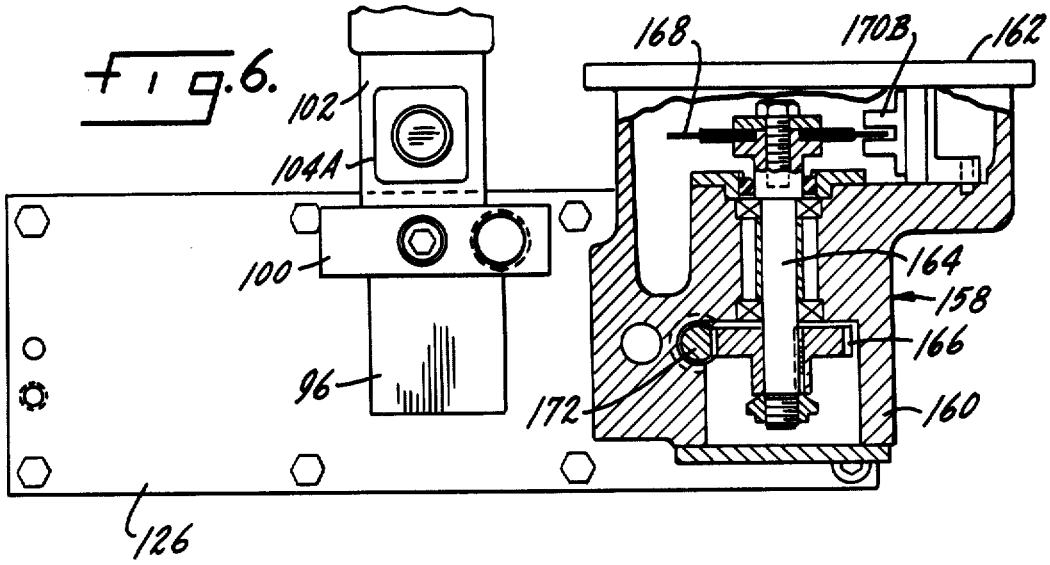
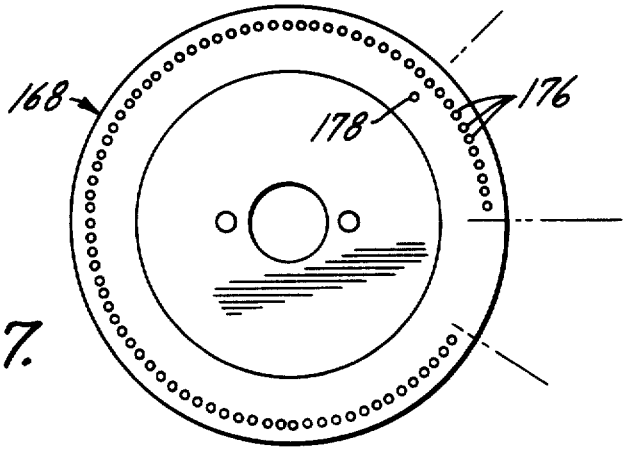
Fig. 7.

MOVABLE GRID STACKER FOR A FOOD SLICING MACHINE

CROSS REFERENCE TO RELATED APPLICATION

The stacker of the present invention is preferably incorporated in a food loaf slicing machine of the kind described and claimed in the co-pending application of Scott A. Lindee and Glenn A. Sandberg, Ser. No. 309,699, filed Oct. 8, 1981.

BACKGROUND OF THE INVENTION

This invention relates to food processing machinery and, more particularly, to a stacker with a weighing scale, for a food loaf slicing machine. The stacker of the present invention is designed for use in a high production facility, e.g., the stacker-scale is intended to handle the output of a slicer which operates at a rate of about one thousand slices per minute.

A prevalent problem in stacking food loaf slices for packaging is maintaining the slices in registry on the stack. One cause of misaligned slices in a stack is free fall of a slice from the cutting station onto the stack. The same difficulties occur if subsequent transfer movements of the stack entail any free fall. There is an inherent lack of control during any appreciable free fall, which leads to misregistration of slices in the stack. Obviously, a misaligned stack is undesirable from an esthetic viewpoint; a misaligned stack also complicates further handling and packaging.

The alignment problem for a stacker is most acute when the stacker must accept the output of a high production slicer, operating at rates of several hundred to one thousand or more slices per minute. In such a slicer, the knife that cuts the slices imparts substantial force to each slice as cut; if the slices are not captured immediately by the stacker, accurate alignment of slices in the stack is most difficult and often virtually impossible to maintain. Furthermore, the rapid transfer movements required to weigh and remove the stacks as formed, in a high production application, accentuate the problems of maintaining accurate registry. Free fall occurring at any stage of the operation almost inherently produces misaligned, unsatisfactory stacks.

SUMMARY OF THE INVENTION

It is a principal object of the present invention, therefore, to provide a food loaf slice stacker which affords essentially immediate support for each slice as cut and then provides continuous support during subsequent handling, so that free fall is essentially eliminated.

Another object is to provide a stacker of the type described which can be used in conjunction with a high production slicer.

Another object is to provide a high production rate stacker having a weight scale for measuring the weight of each completed stack to permit immediate correction of any weight discrepancy.

Another object is to provide a stacker which can accommodate food loaf slices of different thicknesses and can accumulate different numbers of slices per stack.

Accordingly, the stacker is used in conjunction with a food loaf slicing machine of the kind in which a food loaf is advanced generally downwardly into a slicing station in which slices of generally uniform thickness are cyclically sliced from the lower end of the loaf; each slicing cycle includes a slicing interval followed by a loaf advance interval, with the stacker forming stacks of N slices. The stacker comprises first and second stack supports, each movable along a predetermined closed loop path from an initial slice receiving position, immediately below the slicing station, at which the stack support receives a first food loaf slice as cut with essentially no free fall, downwardly through a range of N − 1 additional slice receiving positions, each displaced approximately one additional slice thickness downwardly from the slicing station to a discharge position displaced from the final slice receiving position, where the stack is removed from the stack support. The stack support next moves to a ready position adjacent to the slicing station and then finally returns to the initial slice receiving position to begin a new stacking cycle. Stack support drive means are operatively connected to the stack supports for moving each stack support member through its closed loop path in 2N slicing cycles with the second stack support moving from its ready position to the initial slice receiving position immediately after the first stack support moves from its final slice receiving position toward its discharge position sufficiently to afford clearance from the top slice of a stack on the first stack support. Stack discharge means remove a stack of slices from a support at its discharge position, where the stack is weighed, with no free fall.

BRIEF DESCRIPTION OF THE DRAWINGS

FIG. 5 is a detail section view taken substantially along line 5—5 in FIG. 4.

FIG. 6 is a detail section view taken substantially along line 6—6 of FIG. 4;

FIG. 7 is an elevation view of an encoder disk used in the stacker.

DESCRIPTION OF A PREFERRED EMBODIMENT

General Description

Figure 1:
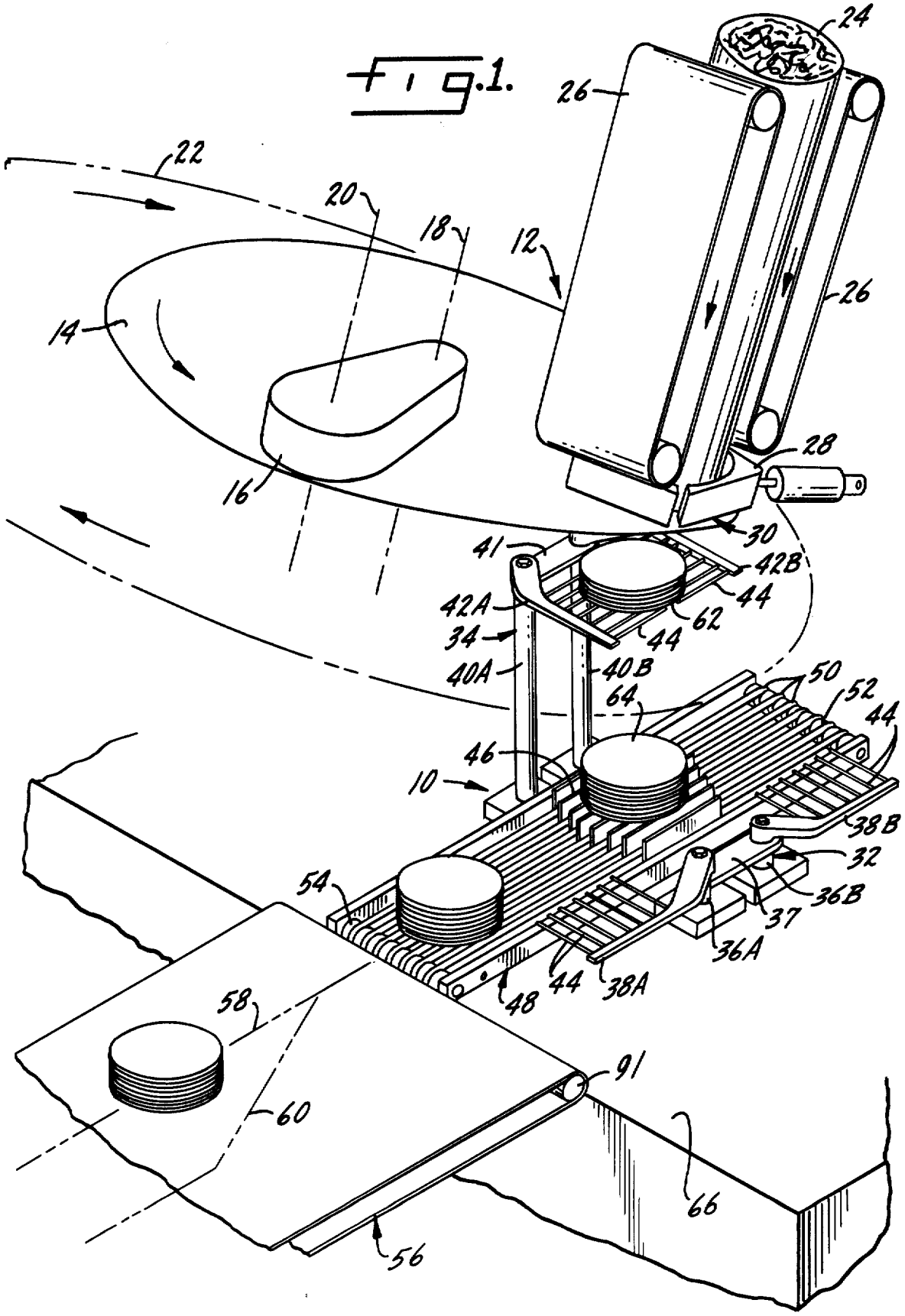
FIG. 1 is a schematic perspective view of a food loaf slicing machine equipped with a stacker according to the present invention.

A stacker 10 for a food loaf slicing machine, constructed in accordance with the present invention, is shown generally in FIG. 1. The stacker 10 operates in conjunction with a food loaf slicing machine 12. The slicing machine has a cutting blade 14 mounted for rotation on an arm 16. The blade 14 rotates about an axis of blade rotation indicated by the line 18. The arm 16 itself revolves around an orbital axis 20. The motion resulting from the combination of blade rotation about axis 18 and orbital movement about axis 20 is the cutting edge path shown at 22. This motion causes the blade 14 to move cyclically into and out of a slicing station 30.

A food loaf 24 is continuously advanced generally downwardly into the slicing station 30 by a pair of loaf conveyors 26. The food loaf 24 is engaged at its lower end by a collar 28. The slicing station 30 is immediately below the collar.

Each complete orbital movement of the cutting blade 14 about the axis 20 defines a slicing cycle. Each slicing cycle includes a slicing interval followed by a loaf advance interval. During the slicing interval the cutting blade 14 is in the area of the slicing station 30 and is cutting a slice from the end of the advancing food loaf 24. When the cutting blade moves out of the slicing station the loaf advance interval begins. During each slicing cycle, the loaf conveyors 26 operate continuously, advancing the food loaf into the slicing station 30 a distance equal to the desired slice thickness during each cycle. When the cutting blade re-enters the slicing station in each slicing interval, a slice having a thickness equal to the amount of loaf advancement is cut from the loaf 24. The cutting blade operation is continuous. It is the task of the stacker 10 to receive the slices as they are cut, forming stacks of N slices per stack. A preferred construction for the slicer 12 is described and claimed in the aforementioned co-pending application of Scott A. Lindee and Glenn A. Sandberg, Ser. No. 309,699, filed Oct. 8, 1981. In that slicing machine, food loaf movement is continuous throughout the slicing and loaf advance intervals.

The stacker 10 includes first and second stack supports, shown generally at 32 and 34, respectively. The first stack support 32 comprises a pair of grid support rods or shafts 36A and 36B. The grid support rods are connected by a tie bar 37. Affixed to the tops of the grid support rods are a pair of stacking grids 38A and 38B. The second stack support 34 has a structure corresponding to the first stack support, comprising a pair of grid support rods or shafts 40A and 40B, connected by a tie bar 41. Two stacking grids 42A and 42B are attached to the tops of the grid support rods 40A and 40B, respectively. Each of the stacking grids 38A, 38B and 42A, 42B has a plurality of spaced, generally parallel tines 44 on which the food loaf slices are collected.

The stacker 10 further includes weight scale means for weighing completed stacks. The uppermost portion of the weight scale, the only portion of the scale seen in FIG. 1, comprises a plurality of top-of-scale vanes 46. As explained more fully below, the vanes 46 are connected to a load cell which measures the weight of each stack of food loaf slices deposited on the vanes. A scale conveyor 48 has a plurality of elongated, flexible bands or O rings 50 which engage a drive roll 54 and an idler roll 52. The bands 50 are positioned between the top-of-scale vanes 46 and are normally below the top edges of the vanes 46. When a stack has been weighed the scale conveyor 48 tilts upwardly about the axis of the drive roll 54, thereby raising the conveyor bands 50 above the vanes and into contact with the bottom of a stack of food loaf slices. The scale conveyor bands 50 then carry the stack to a discharge conveyor 56. Once the stack is clear of the scale vanes 46 the scale conveyor 48 is pivoted back to its normal, horizontal position so that the vanes 46 can receive the next stack. A stack whose weight is within acceptable limits travels down the path 58 on the discharge conveyor 56. The weight scale may be used to trigger a diverter (not shown) to cause an out-of-tolerance stack to be diverted along a different path 60.

The first and second stack supports 32 and 34 each move along a predetermined closed-loop path beginning at an initial slice receiving position, immediately below the slicing station 30. At this position the stack support receives a first food loaf slice as cut, with essentially no free fall. The stack support then moves downwardly through a range of additional slice receiving positions, each displaced approximately one additional slice thickness downwardly from the slicing station. In FIG. 1 the second stack support 34 is shown as having received several food loaf slices 62, less than a complete stack, and is in position to receive another slice. Actually, the stacking grids 42A and 42B would be even closer to slicing station 30 than shown in FIG. 1, since they must receive the slices 62 with essentially no free fall.

Once the desired number of slices N have been deposited on a stack (in this specification it is assumed that N=8, but that number is subject to substantial variation), the stack support moves rapidly downwardly to a discharge position displaced from the final slice receiving position. As one stack support starts to move down toward the discharge position, the other stack support moves into its initial slice receiving position and begins the measured descent required to receive additional slices. At the discharge position the stack is decelerated by the "cushion" afforded by the hydraulic cylinder drive for the stack support and is transferred to the top-of-scale vanes 46 and the stacking grids are then swung out or opened to permit the operation of the scale conveyor described above. In FIG. 1 the grids 38A, 38B of the first stack support 32 are shown in their open position after delivering a completed stack 64 to the top-of-scale vanes 46. The first stack support 32 is next moved from the illustrated position to a raised ready position adjacent to the slicing station 30. Then the stacking grids 38A,38B swing in or close at the initial slice receiving position, thereby completing the closed-loop path of the stack support. The timing of the stacker operation is such that a stack support or the top of a stack itself is always immediately below the slicing station 30 so that each slice, as cut, is deposited directly on a support grid or on the top of the stack with essentially no free fall.

OVERALL CONSTRUCTION OF THE MACHINE

Figure 2:
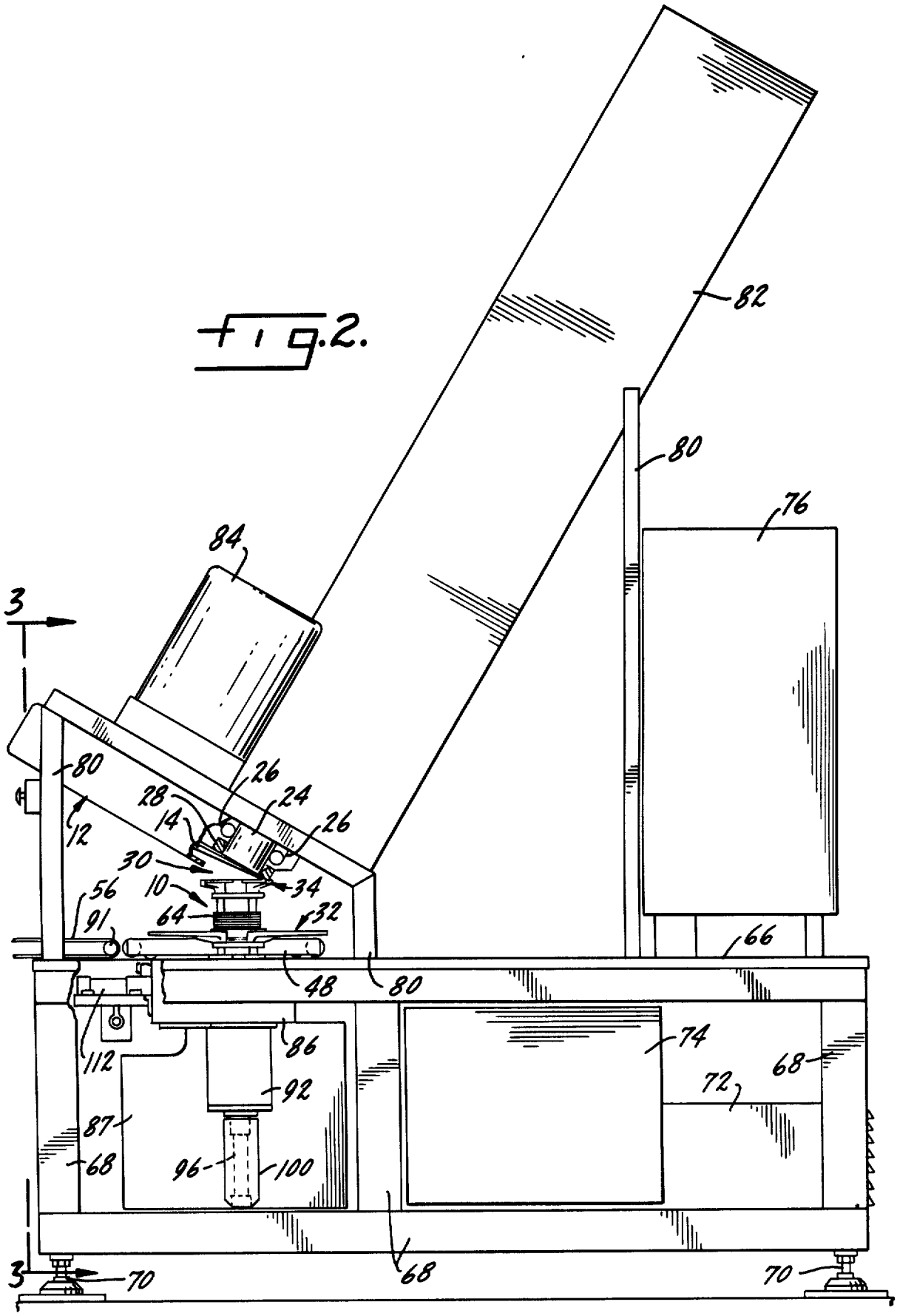
FIG. 2 is a side elevation view, with portions cut away, of the machine of FIG. 1.
Figure 3:
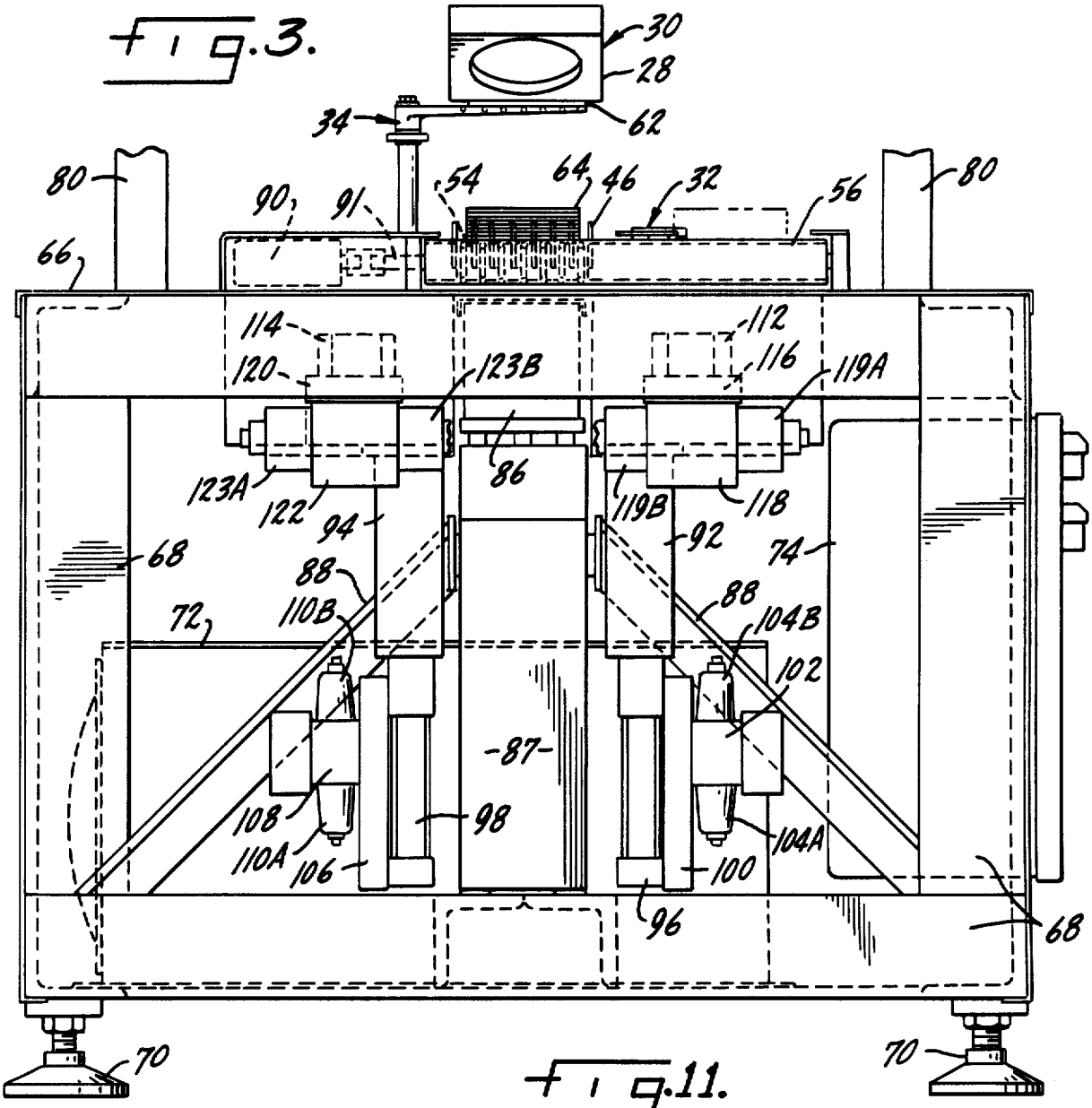
FIG. 3 is an end elevation view of the stacker mechanism, looking in the direction of line 3—3 in FIG. 2.

FIGS. 2 and 3 illustrate the general construction of the stacker 10 and its relation to the slicer 12. The stacker 10 and the slicer 12 are mounted on a base 66. The base 66 is supported by frame members 68 which in turn rest on feet 70. Located within the enclosure formed by the base 66 and frame members 68 are a hydraulic tank 72 and a motor control unit 74. Mounted on top of the base 66 is an electronic control panel 76. Vertical supports 80 mount the slicer 12 and a food loaf guide 82 on the base 66 (FIG. 2). The loaf guide 82 encloses the loaf conveyors 26 as well as the food loaf 24 itself. A knife drive 84 is incorporated in the slicer 12.

The stacker 10 includes a central housing 86 for a weight scale load cell. The load cell housing 86 is mounted on a massive weight 87 (e.g., 500 lbs.) that is connected to lateral support members 88. Mounting of the load cell on the large weight 87 aides in minimizing weighing errors due to vibrations induced by the presence of the knife drive 84 and the drive mechanism of the stacker 10. FIG. 3 also shows a drive motor 90 coupled to a drive shaft 91 for the discharge conveyor 56.

STACK SUPPORT DRIVE MEANS

FIGS. 2 and 3 afford a general illustration of the drive means for operating the stack supports 32 and 34. Separate drive means are provided for each of the first and second stack supports. The drive means includes first and second stacker support drive housings 92 and 94 for the first and second stack supports 32 and 34, respectively. Associated with each stacker housing is a lift cylinder for vertically positioning the stack support and a grid swing cylinder for pivoting the stack support grids between their open and closed positions. Thus, the first and second stacker housings 92 and 94 are mounted above the lift cylinders 96 and 98, respectively. A hydraulic manifold 100 is connected to the lift cylinder 96 and a valve 102 is mounted on the manifold. Two solenoids 104A and 104B control the valve 102. The lift cylinder 98 similarly has a manifold 106, a valve 108, and two solenoids 110A and 110B.

The stacker drive means also include two grid swing hydraulic cylinders 112 and 114 (FIG. 3). Grid swing cylinder 112 has a pressure fluid manifold 116 for supplying fluid to the cylinder in accordance with the positioning of a valve 118 controlled by two solenoids 119A and 119B. Similarly, the grid swing cylinder 114 has a manifold 120, a three-way valve 122, and two control solenoids 123A and 123B.

FIGS. 4–7 show the stacker drive means in greater detail. The first stack support 32 and its associated drive means are shown and described but it will be understood that a corresponding drive means is provided for the second stack support 34.

The stacker housing 92, which may be an aluminum casting, provides an enclosure for the moving parts of the stack support drive. The housing has a central horizontal wall 124. The stacker housing 92 is enclosed by a bottom plate 126, a cover plate 128 and a door 130 (FIG. 5). Suitable gaskets (not shown) may be provided to prevent loss of lubricant from within the stacker housing. A seal block 132 affixed to the cover plate 128 provides additional sealing at the point where grid support rods 36A and 36B emerge from the stacker housing. The grid support rods 36A and 36B extend downwardly through the seal block 132, the cover plate 128 and the wall 124. The lower end portions of the rods are splined as shown at 134. The extreme lower ends of the grid support rods 36A, 36B are journalled in thrust bearings 135 in a yoke 136. The piston rod 138 of the lift cylinder 96 extends upwardly through the bottom plate 126 and is connected through an alignment coupling to the yoke 136. Thus, the lift cylinder 96 is effective to raise and lower the grid support rods 36A and 36B.

Figure 4:
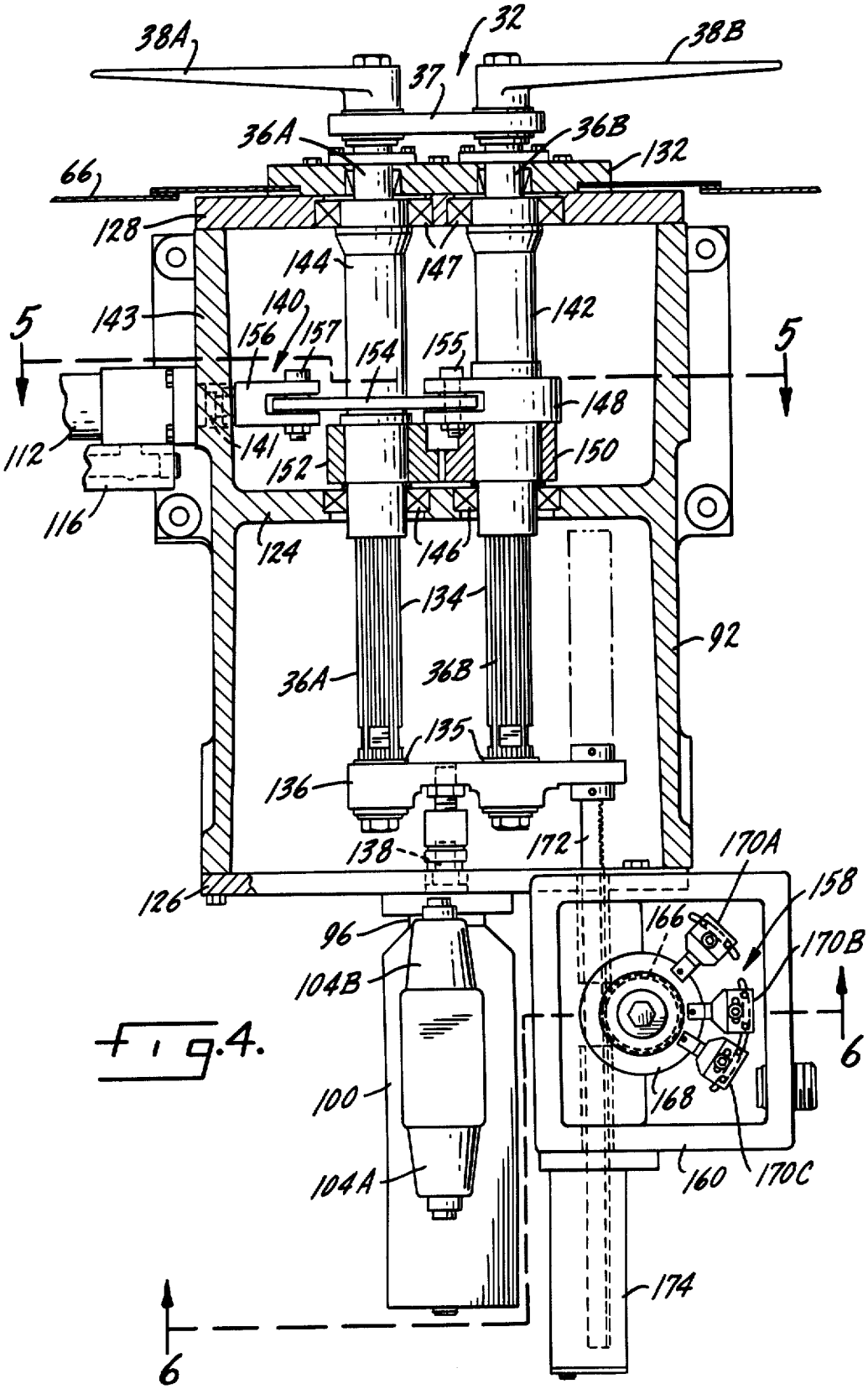
FIG. 4 is a front elevation view of a stack support drive mechanism, with portions removed to show the operative structure.

The grid swing mechanism for the first stack support 32 is shown generally at 140 in FIGS. 4 and 5. It is connected to the piston rod 141 of grid swing cylinder 112 through an opening in a side wall 143 of the stacker housing 92. The grid swing mechanism 140 includes a hollow drive shaft 142 and a hollow driven shaft 144. Both shafts are journalled in bearings 146 and 147 which are mounted in the wall 124 and the cover plate 128, respectively.

The lower ends of the shafts 142 and 144 are internally splined to engage the splined portions 134 of the grid support rods 36A and 36B. A drive arm 148 is clamped to the exterior of the drive shaft 142. Beneath the drive arm 148 is a segmental drive gear 150, affixed to the exterior of the drive shaft 142. The gear 150 engages a driven gear 152 which is mounted on the exterior of the driven shaft 144. As shown in FIG. 5, the driven gear 152 is keyed to the shaft 144 and both the drive arm 148 and drive gear 150 are keyed to the shaft 142. The drive arm 148 includes a clevis to which one end of a connecting bar 154 is fastened by a pin 155. A clevis 156 is connected to the other end of the bar 154 by a pin 157 and is in turn connected to the piston rod 141 of the grid swing cylinder 112.

FIG. 4 shows the stacking grids 38A and 38B in an open or swung out position. To swing in or close the stacking grids, the cylinder 112 is actuated to drive the piston rod 141 outwardly of the cylinder, to the right as seen in FIGS. 4 and 5. This pushes the clevis 156 and connecting bar 154 to the right as seen in FIG. 4, the bar 154 moving to the phantom position 154A (FIG. 5). When this occurs the drive arm 148 rotates in a counterclockwise direction, as seen in FIG. 5. The drive gear 150 also rotates counterclockwise and causes the driven gear 152 to be rotated in a clockwise direction, again as seen in FIG. 5. This rotation of the gears 150 and 152 in turn rotates the two shafts 142 and 144. By virtue of the splined engagement of the tubes with the grid support rods 36A and 36B, the support rods also rotate with the shafts. This rotation brings about the closure of the stacking grids 38A and 38B. Subsequent opening of the grids is effected by retracting piston rod 141, returning the parts to the solid line positions of FIG. 5.

GRID POSITION ENCODER

Control of the motion of the stack supports 32 and 34 makes it desirable to provide explicit position information to suitable control apparatus. This information, as regards vertical positioning of the stack supports, is provided by an encoder shown generally at 158 in FIGS. 4 and 6. The encoder 158 includes a housing 160 mounted below the stacker housing 92. Access to the encoder mechanism is provided through a door 162, FIG. 6; the door has been removed in FIG. 4. An encoder shaft 164 is rotatably supported within the housing 160. A gear 166 is mounted at one end of the shaft while the other end carries an encoder disk 168. A plurality of sensors 170A, 170B, and 170C are mounted in the encoder housing in alignment with the encoder disk 168.

A rack 172 is connected to an extension of the yoke 136 in the stacker housing 92. The rack 172 extends through the bottom plate 126 of the housing 92 and into the encoder housing 160. A rack housing 174 accommodates the rack when it is at its lowest extent. The rack teeth engage those of the gear 166. Thus, as the rack 172 moves up and down with the yoke 136 it causes rotation of the shaft 164 and, consequently, the encoder disk 168.

As seen in FIG. 7 the encoder disk 168 has a multiplicity of holes or openings 176 on an outer radius, extending around most of the periphery of the encoder disk 168, and one hole 178 on an inner radius. The sensors 170A–170C each include a photoelectric sensor; the sensor 170A is aligned with the openings 176 in the disk 168 and the sensors 170B and 170C are aligned with the disk opening 178. Thus, the encoder sensor 170C is effective to signal arrival of the stack supports 36A and 36B at the lowermost position in their path of movement, the sensor 170B signals arrival of the stack supports at their fully raised (ready) position, and sensor 170A provides pulse signals enabling a counter (not shown) to monitor all intermediate positions of the stack supports and to measure the velocities of their vertical movements. Suitable limit switches (not shown) can be used to determine movements of the support grids between their open and closed positions.

SCALE CONVEYOR

Figure 8:
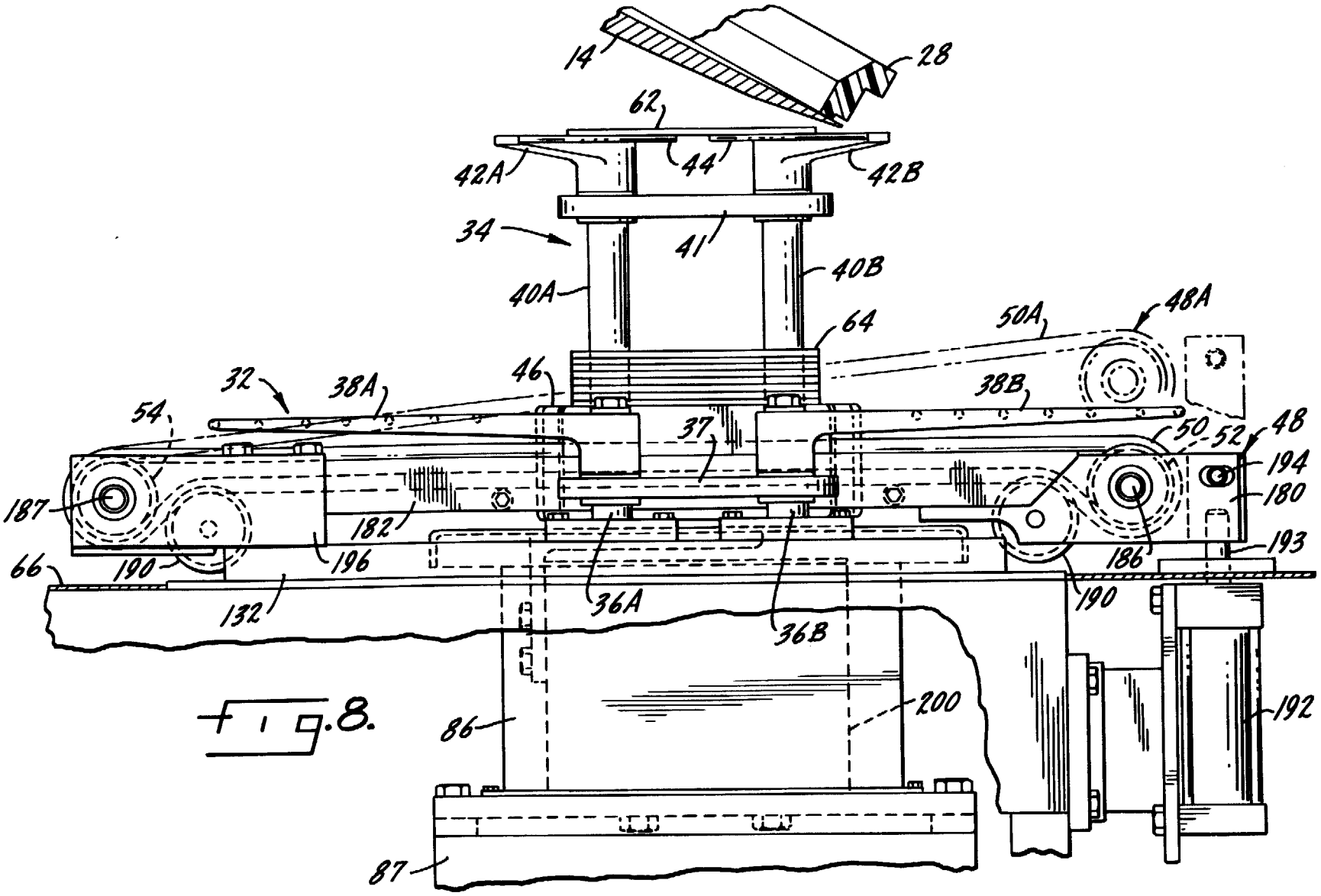
FIG. 8 is a side elevation view of the weight scale and scale conveyor.
Figure 9:
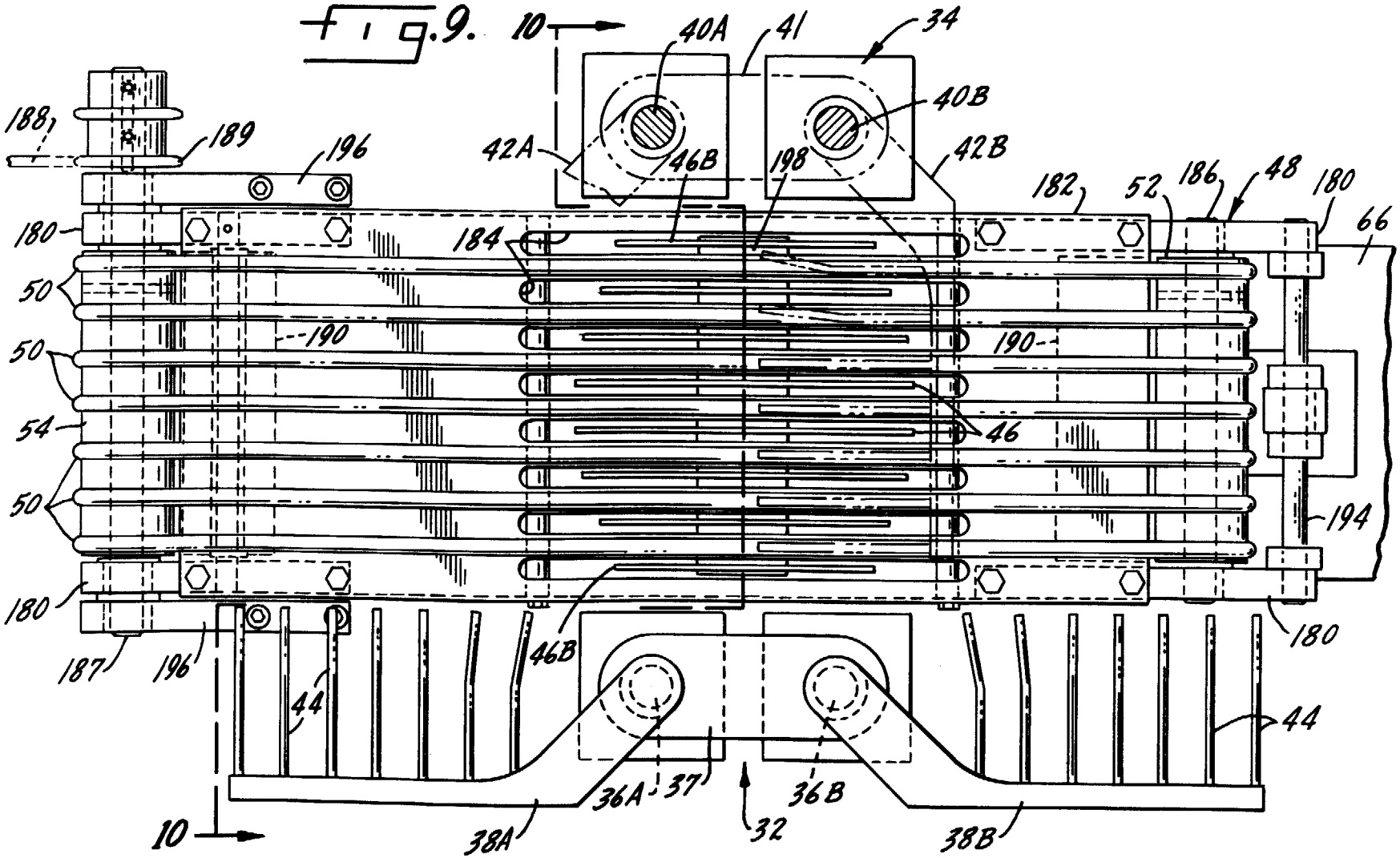
FIG. 9 is a plan view of the scale conveyor, also showing the stack support grids.
Figure 10:
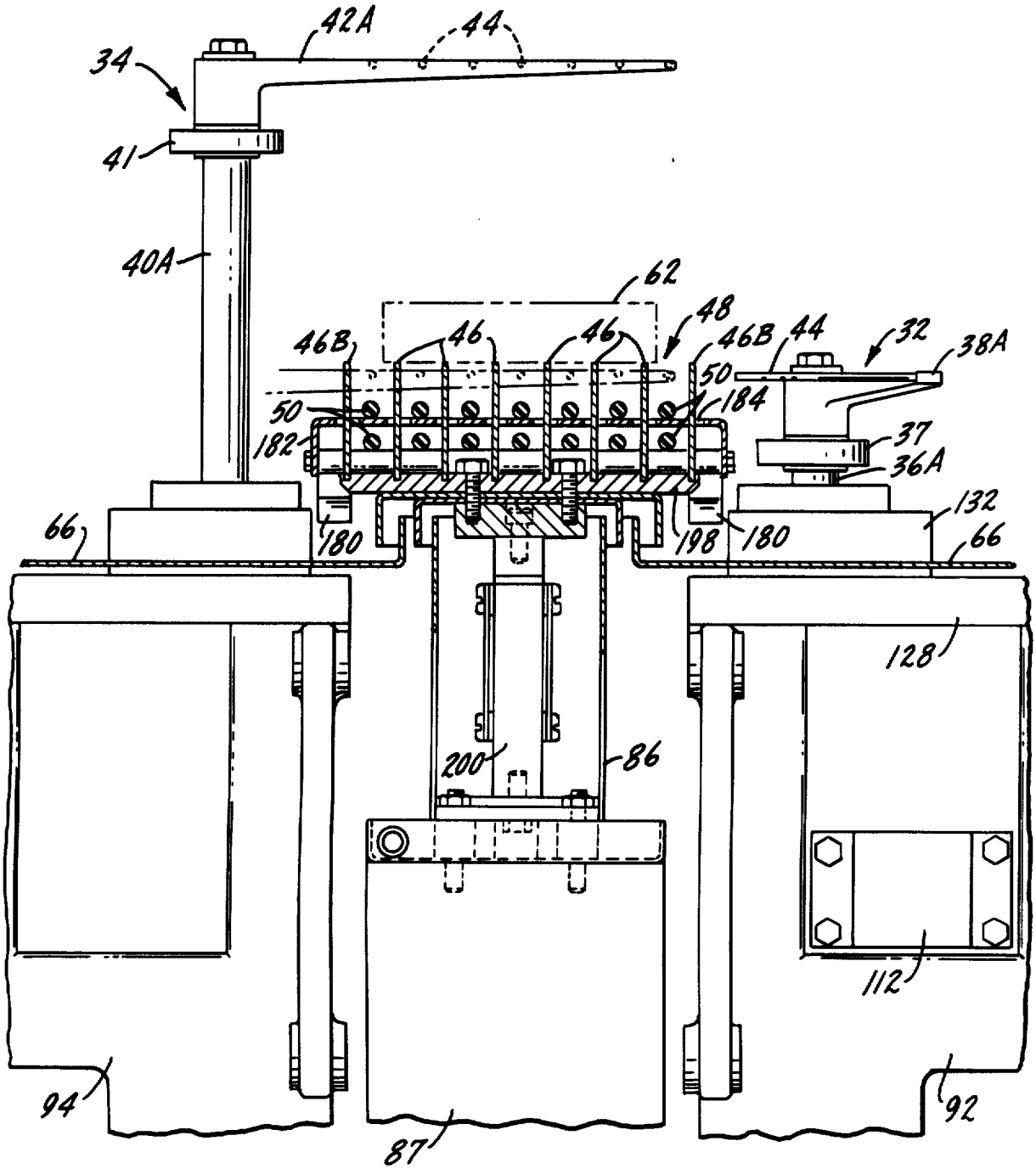
FIG. 10 is a section view taken substantially along line 10—10 of FIG. 9.

The scale conveyor 48 is shown in detail in FIGS. 8-10. The scale conveyor has four frame members 180 mounted on the corners of a plate 182. The plate 182 has a plurality of slots or openings 184 through which the top-of-scale vanes 46 extend. Two shafts 186 and 187 extend between the corner members 180 to support the conveyor rolls 52 and 54, respectively. A drive belt (or chain) 188 engages a sprocket 189 on shaft 187, as shown in FIG. 9, for driving the scale conveyor. The elongated bands 50 of the conveyor are guided on the forward or upper run by the plate 182. On their return or lower run the bands are guided over a pair of idler rolls 190. The idler rolls are mounted on shafts supported by the corner frame members 180.

A scale lift cylinder 192 is connected to the right hand end of the conveyor 48, as shown in FIGS. 8 and 9. The cylinder 192 has a piston rod 193 connected to shaft 194 which extends between the two corner frame members 180. The scale conveyor 48 is pivoted about the shaft 187, which extends into hinge blocks 196 affixed to the base 66 of the machine. Thus, the scale conveyor is movable between a horizontal "down" position and a tilted "up" position 48A, the up position being shown in FIG. 8 in phantom.

When the scale conveyor is in the horizontal "down" position, the conveyor bands 50 are below the top-of-scale vanes 46, as shown in FIG. 8. When a stack support deposits a stack 64 on the top-of-scale vanes and the grids have swung out, then the weighing process takes place. When weighing is completed the scale lift cylinder 192 raises the scale conveyor 48 to the up position with the bands in position 50A. Thus, the conveyor bands 50 lift the stack 64 off of the scale vanes 46 and remove the stack to the discharge conveyor 56, FIGS. 1-3.

WEIGHT SCALE

The weight scale is best seen in FIG. 10. The individual top-of-scale vanes 46 are fastened to a scale top plate 198. It will be noted that the outer vanes 46B are shorter than the central vanes to permit the grid tines 44 to swing in and out. The scale plate 198 is connected to an electrical load cell 200. The load cell 200 provides a measurement of the weight of a stack. The weight information can be used to control the diverter on the discharge conveyor. It can also be used to control the speed of the loaf advance conveyors 26 to adjust the slice thickness to prevent over or under-weight stacks. The weight information from the load cell 200 could also be employed for printing weight data on finished packages of the food loaf slices.

HYDRAULIC CIRCUIT

Figure 11:
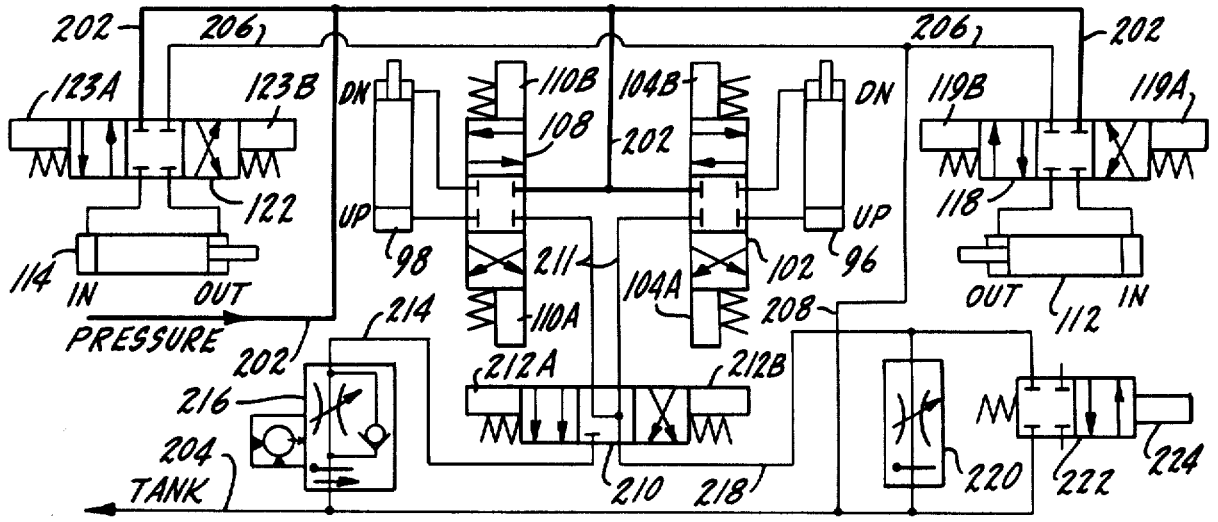
FIG. 11 is a schematic diagram of the hydraulic circuit for the stacker.

The hydraulic circuit is shown in schematic form in FIG. 11. High pressure hydraulic fluid is supplied from a source (not shown) through an input line 202 to each of the valves 118 and 122 for the grid swing cylinders 112, 114, respectively, and to the valves 102 and 108 for the grid lift cylinders 96,98. Hydraulic fluid is returned to a tank through a drain line 204. The discharge sides of the grid swing valves 118 and 122 are connected directly to the drain line 204 through lines 206 and 208. The discharge lines of the grid lift valves 102 and 108 are connected, by two lines 211, to a control valve 210 actuated by two solenoids 212A and 212B. A line 214 connects the valve 210 to an electrically actuated adjustable flow controller 216. A line 218 connects the valve 210 to another flow controller 220 which is manually adjustable. The flow controller 220 can be bypassed by a valve 222 which is actuated by a solenoid 224. The purpose of the valve 210 and the flow controllers 216 and 220 is to control the rate of fluid discharge from the grid lift cylinders 96 and 98 and thereby control the speed at which the stack supports move up and down. It will be noted that all of the hydraulic cylinders are double-acting cylinders and the hydraulic control valves are all solenoid-actuated with spring return.

OPERATION OF THE STACKER

Operation of the stacker will be described with reference to the hydraulic schematic of FIG. 11 and the timing diagram of FIG. 12. Looking initially at FIG. 12, the upper portion of the timing diagram is a composite showing the vertical positions of the first and second stack supports 32 and 34 and of the scale conveyor 48 on a time basis, over a full cycle of the stacker during which two complete stacks of N slices each are formed, assuming N=8. The vertical axis of this portion of the chart represents the relative vertical positions of the stacker components. The vertical stroke of the stack supports 32 and 34 is about five inches. The horizontal axis represents time. Along the bottom of the composite chart the time is marked in intervals of one hundred milliseconds. At the top of the chart the time is divided into sixteen slicing cycles. Each cycle represents a complete orbital revolution of the knife of the slicer 12. As illustrated for the first slicing cycle, the 360° cycle includes a 90° slice interval followed by a 270° loaf advance interval in which no slicing occurs. As noted above, the loaf may advance continuously throughout both intervals. In a preferred embodiment the complete slicing cycle lasts sixty milliseconds at 1000 slices per minute; for lower slicing rates there is a corresponding increase in the slicing cycle duration. A food loaf slice is cut from the loaf during each slice interval in each cycle. The lower portion of the timing chart depicts the motion of the stack supports and grids on an individual basis, using the same time scale as the upper part of FIG. 12.

Figure 12:
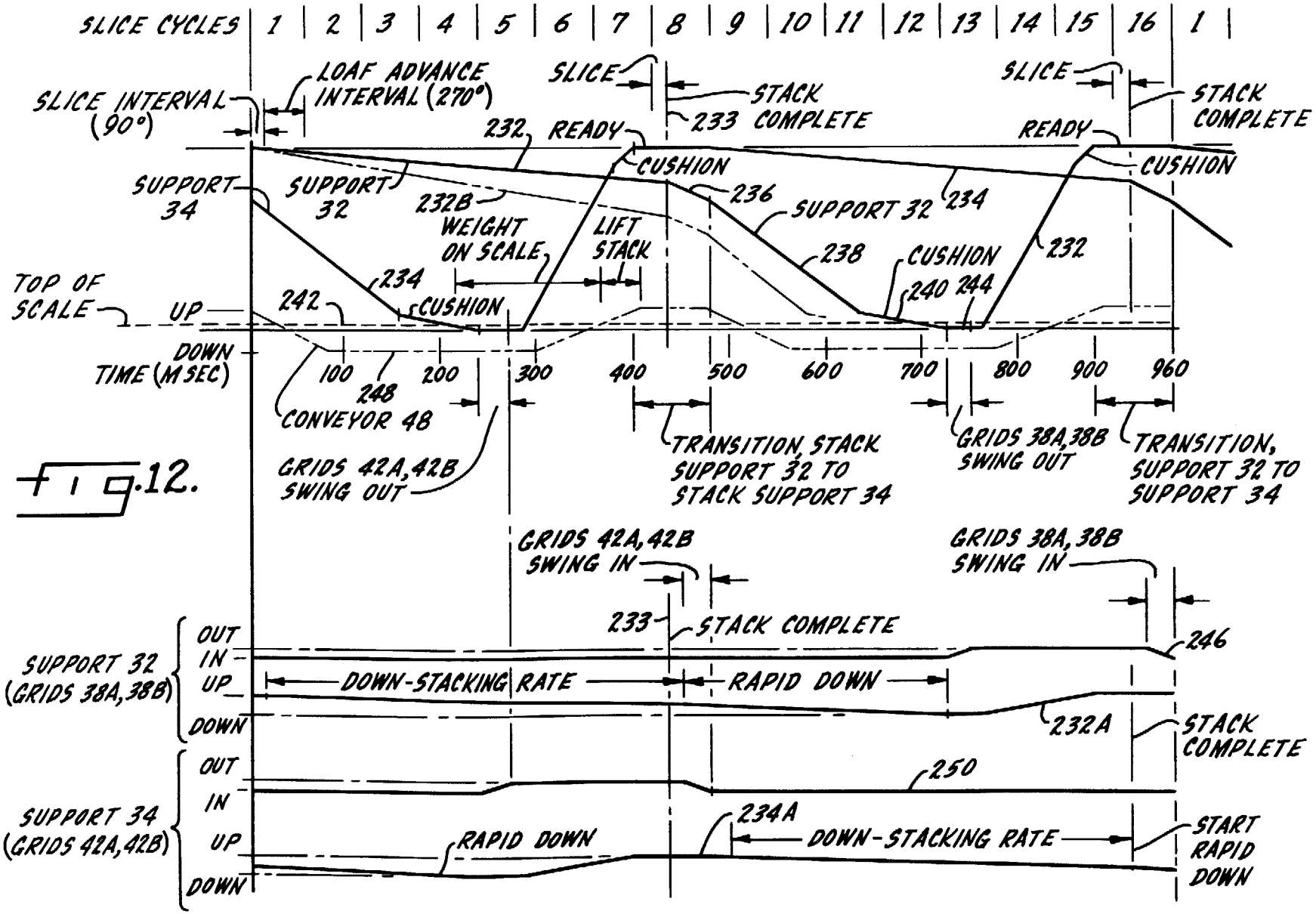
FIG. 12 is a timing diagram, showing the sequence of operation of the various stacker parts.

As previously noted, the timing chart, FIG. 12, shows the machine operation for forming stacks of eight food loaf slices per stack. The first stack support 32 receives food loaf slices during slice cycles 1 through 8. As soon as the first stack is complete, the second stack support 34 moves into the slice receiving position to receive slices during cycles 9 throught 16. During cycles 9-16 the first stack support lowers its stack to a discharge position and then returns to a ready position adjacent to the slicing station. When the stack on the second support 34 is complete, the first stack support 32 moves back to the initial slice receiving position, where it started the first slice cycle, and the entire pattern repeats. Thus, the closed-loop path of motion of a particular stack support occurs over a time span of sixteen slice cycles, which in this instance represents 2N slice cycles. It will be understood, of course, that a stack could have a different number of slices. The machine operation would then be adjusted accordingly. An appropriate electrical control circuit (not shown) is provided to control the machine operations.

The closed-loop path of the first stack support 32 is indicated in FIG. 12 by the line 232. It begins in the first cycle with the grids 38A, 38B fully raised and closed in an initial slice receiving position immediately below the slicing station 30 (FIG. 1). During the slicing interval of the first cycle of a food loaf slice is cut by the knife and is deposited on the stacking grids with essentially no free fall. During the subsequent loaf advance interval in the first cycle the support 32 moves downwardly, at a rate matched to the feed rate of the loaf into the slicer, to provide clearance for the next food loaf slice. The support 32 continue to move downwardly, at the same rate as the food loaf advance, through a range of slice receiving positions during the first eight slicing cycles. This so-called "down-stacking rate" motion is of the order of two inches per second; it is varied in accordance with the desired slice thickness. The down-stacking rate motion of support 32 is also indicated in the lower portion of the timing diagram by the first part of line 232A.

In the hydraulic circuit diagram, the "down-stacking rate" motion for the stack support 32 is brought about by energizing the solenoid 104B to supply hydraulic fluid to the "down" side of cylinder 96, causing the piston in the cylinder 96 to move downwardly. The solenoid 212B is also actuated throughout the down-stacking rate motion of the support 32. This actuates the control valve 210 to direct discharge fluid from the cylinder 96 to the flow controller 216. The controller 216 restricts the discharge flow from cylinder 96 so that the desired relatively slow downward motion of the support 32 is maintained.

After the slice interval of the eighth slice cycle, the stack on the grids 38A, 38B of the support 32 is complete. This is indicated in FIG. 12 by the vertical line 233, labeled Stack Complete. At this time the solenoid 212B is deenergized, allowing the valve 210 to return to its neutral position. Simultaneously, the solenoid 212A is energized so that the valve 210 is actuated to its alternate end position. The discharge from cylinder 96 is then connected to the drain line 204 through the valve 210, the line 218, and the flow controller 220. This results in a more rapid downward movement of the support 32, as indicated by the short portion 236 of the path 232 of stack support 32 in FIG. 12. The initial rapid down movement rate is about ten inches per second. The initial rapid-down motion starts immediately after the end of the slicing interval in the eighth (Nth) slice cycle. At the beginning of the ninth (N+1) cycle, the solenoid 224 is energized, actuating the valve 222 to bypass the flow controller 220 and thus connect the discharge of the cylinder 96 directly to the drain line 204. This allows the grid support 32 to move downwardly even more rapidly (about twenty-six inches/-second) as indicated by the segment 238 of the line 232.

During the ninth (N+1) slice cycle the second stack support 34 receives its initial slice and begins its down-stacking rate movement, as indicated by line 234 in FIG. 12.

As the stack support 32 approaches the discharge position, during the eleventh slicing cycle (FIG. 12) the hydraulic cylinder 96 that actuates the stack support nears the end of its travel. Consequently, the "cushion" afforded by the cylinder results in deceleration of the stack support as shown by the segment 240 of the line 232 in FIG. 12.

At about the 700 millisecond mark, during the twelfth cycle, the stack support 32 moves down far enough to bring its grid 38A, 38B below the top-of-scale vanes 46, whose position is indicated by the line 242 marked with the legend Top Of Scale. The stack is then supported on the scale vanes 46 while the support grids continue to move down slightly below the vanes to the discharge position 244. The stack is weighed at this time. Just after the start of the thirteenth cycle the solenoid 104B is deenergized so that the valve 102 no longer supplies fluid under pressure to the cylinder 96. The downward motion of the support 32 stops with the support in its discharge position. At about the same time, the solenoid 119A is energized, actuating the valve 118 to supply fluid pressure to the "Out" side of the grid swing cylinder 112, thereby causing the grids 38A and 38B to swing out to their open positions as described above. The time required to swing the grids out is about 30 milliseconds. The grid swing motion is indicated individually by line 246 in FIG. 12.

During the thirteenth slicing cycle the solenoid 104A is energized so that the valve 102 supplies fluid pressure to the "Up" side of the cylinder 96. The solenoid 212A is still energized at this time. Thus, the valve 222 is actuated so that the discharge from the cylinder 96 is connected directly to the drain line 204; accordingly, the cylinder 96 rapidly raises the stack support 32 to a ready position with its grids 38A, 38B adjacent to but swung out from the slicing station. The rate of rise is about forty-six inches per second.

While the support 32 is rising the scale conveyor 48 is also tilting to its up position. This is shown by the line 248, also labelled Conveyor 48. The conveyor begins to rise at the beginning of the fourteenth cycle. Shortly after the start of the fifteenth cycle the scale conveyor rises above the top of scale vanes 46 (line 242) so that the stack is carried off the vanes by the conveyor 48.

Near the end of the fifteenth cycle the grids on the support 32 reach the ready position adjacent to the slicing station 30. During the last portion of the sixteenth cycle the solenoid 119B is energized to actuate the valve 118 and supply fluid pressure to the "In" side of the grid swing cylinder 112. When the grids 38A and 38B swing in, the closed-loop path of the stack support 32 is complete and cycles one through sixteen are then repeated.

The closed-loop path of the second stack support 34 is shown by the lines 234 and 234A in FIG. 12. It will be noted that this path is the same as the path 232 for the first stack support 32, but is 180° out of phase therewith. The action of the grids 42A, 42B on the support 34 is shown by the line 250. The operation of the hydraulic circuit for the stack support 34 and its grids 42A, 42B is the same as that described for the support 32. Of course, the scale conveyor 48 moves upwardly to remove the stack deposited on the scale vanes 46 by the second stack support; this occurs during the sixth and seventh slice cycles.

Careful coordination of the operation of the stack supports 32 and 34 and their support grids 38A,38B and 42A,42B is required throughout the sixteen (2N) cycles. One particular point should be noted at the transition intervals shown for cycles seven and eight and cycles fifteen and sixteen. When a stack is complete the grids supporting that stack start a rapid downward motion before the other grids waiting in the ready position begin their swing in motion to the receiving position. This allows the top slice on the completed stck to clear the initial slice receiving position of the incoming grids in time to avoid interference. The reason for keeping the initial rapid downward movement of the grids at a speed less than the subsequent rapid downward movement (compare segments 236 and 238 of line 232) is simply to avoid dropping the grids faster than gravity can accelerate the stack itself.

In order to accommodate different food loaf slice thicknesses, the stack supports' range of slice receiving positions must also be variable. That is, if slice thickness is increased the stack support must move downwardly an increased amount for each slice cycle, requiring a higher rate of downward stacking movement. This is accomplished by adjustment of the flow controller 216 to increase the flow rate of the discharge from the grid lift cylinders. By increasing the flow rate at the controller 216 the down-stacking rate is increased. In the timing diagram, line 232B shows the down-stacking rate movement of the stack support 32 when the slice thickness is doubled as compared with the slice thickness for the line 232. The rate would be about four inches per second for line 232B as compared to the two inches per second for line 232.

We claim:

1. A stacker for a food loaf slicing machine of the kind in which a food loaf is advanced generally downwardly into a slicing station in which slices of generally uniform thickness are cyclically sliced from the lower end of the loaf, forming stacks of N slices, the stacker comprising:

first and second pairs of opposed stack supports, the stack supports of each pair each being movable along a predetermined closed-loop path from an initial slice receiving position immediately below the slicing station at which the stack support pair receives a first food loaf slice as cut with essentially no free fall, downwardly through a range of N−1 additional slice receiving positions each displaced approximately one additional slice thickness downwardly from the slicing station, further downwardly to a discharge position displaced from the final slice receiving position, pivotally outwardly of the discharge position, upwardly to a ready position adjacent to the initial slice receiving position, and pivotally inwardly to the initial slice receiving position;

stack support drive means, operatively connected to the first and second pairs of stack supports, for moving each pair of stack supports through its closed-loop path in 2N slicing cycles, with the second pair of stack supports moving from the ready position to the initial slice receiving position immediately after the first pair of stack supports moves from the final slice receiving position toward the discharge position sufficiently to afford clearance from the top slice of a stack on the first pair of stack supports;

and stack discharge means for removing a stack of slices from each pair of supports, at the discharge position, with no free fall.

2. A food loaf slice stcker according to claim 1 and further comprising weight scale means, including a stationary weighing platform located at the discharge position, for weighing each stack of slices as the stack is removed from the stack supports.

3. A food loaf slice stacker according to claim 2 in which each pair of stack supports comprises a pair of stack grids each mounted on a support shaft, each grid comprising a plurality of spaced cantilever support tines, and in which the stack discharge means comprises a plurality of spaced, essentially stationary upwardly projecting vanes constituting the scale platform, the vanes being aligned with the spaces between the support tines so that downward movement of each support grid to the discharge position deposits a stack of slices onto the vanes with no free fall, the tines of each grid being narrow enough and of a configuration to permit them to pivot horizontally out of the spaces between the vanes.

4. A food loaf slice stacker according to claim 1, claim 2, or claim 3, in which the speed of downward movement of each pair of stack supports between the Nth slice receiving position and the discharge position is substantially higher than the speed of downward movement through the range of slice receiving positions.

5. A food loaf slicer stacker according to claim 3 including conveyor means for removing a stack of slices from the stack discharge means, which conveyor means comprises a plurality of endless moving bands aligned with and normally extending through the spaces between the vanes and below the top surface of the vanes, the entire conveyor being pivotally movable about one end to raise the bands above the top surface of the vanes and thereby lift a stack of slices off of the vanes.

6. A food loaf slice stacker according to claim 1, claim 2, or claim 3, in which each pair of stacker grids is mounted on a pair of parallel splined support shafts extending vertically through a pair of hollow rotary drive shafts, with each pair of support shafts yoked together top and bottom and connected to a lift cylinder for driving the support shafts vertically through the drive shafts, and rotary drive means operationally connected to the rotary drive shafts to effect pivotal movement of the pair of grids.

7. A method of forming stacks of N food loaf slices cut by a slicing machine of the kind in which a food loaf advances continuously downwardly into a slicing station where slices of generally uniform thickness are cyclically sliced from the lower end of the loaf, the method comprising the steps of:

A. positioning a first pair of multi-tined cantilever stack supports in alignment at an initial slice receiving position immediately below the slicing station to receive and support a first food loaf slice as cut with essentially no free fall;

B. moving the first pair of stack supports continuously downwardly through a range of N−1 additional slice receiving positions with the stack supports moving downwardly approximately one slice thickness during each slicing cycle so that the top of the stack is always immediately below the slicing station and additional slices are received on the stack with essentially no free fall;

C. rapidly moving the first pair of stack supports, upon completion of a stack of N slices, downwardly to a discharge position located directly below the range of slice receiving positions;

D. positioning a second pair of multi-tined cantilever stack supports in alignment at the initial slice receiving position immediately after the first pair of stack supports move away from their final slice receiving position;

E. removing the stack of slices from the first pair of supports at the disccarge position with essentially no free fall and thereafter pivotally moving each of the first stack supports horizontally away from the discharge position;

F. moving the second pair of stack supports continuously downwardly through the range of N−1 additional slice receiving positions with the stack supports moving downwardly approximately one slice thickness during each slicing cycle so that the top of the stack is always immediately below the slicing station and additional slices are received on the stack with essentially no free fall;

G. during step F, raising the first pair of stack supports upwardly to a level corresponding to the initial slice receiving position;

H. rapidly moving the second pair of stack supports, upon completion of a stack of N slices, downwardly to the discharge position;

I. pivoting the first pair of stack supports horizontally to re-position such supports at the initial slice receiving position; and J. removing the stack of slices from the second pair of supports at the discharge position with essentially no free fall and thereafter pivotally moving each of the first stack supports horizontally away from the discharge position.

8. The method of claim 7 in which the downward movement of each pair of stack supports from the Nth slice receiving position is first effected at an initial fast speed still slow enough to preclude the stack support dropping away from the stack and is subsequently accelerated to a higher speed.

* * * * *